US005470558A

United States Patent [19]

Takashima et al.

[11] Patent Number: 5,470,558

[45] Date of Patent: Nov. 28, 1995

[54] PROCESS FOR PRODUCING PITCH-BASED CARBON FIBERS SUPERIOR IN COMPRESSION CHARACTERISTICS

[75] Inventors: Hiroaki Takashima, Ohta; Osamu Kato; Tsutomu Kihara, both of Yokohama, all of Japan

[73] Assignee: Nippon Oil Company, Limited, Tokyo, Japan

[21] Appl. No.: 245,859

[22] Filed: May 13, 1994

Related U.S. Application Data

[63] Continuation of Ser. No. 882,693, May 14, 1992, abandoned.

[30] Foreign Application Priority Data

May 16, 1991 [JP] Japan ..... 3-206596

[51] Int. Cl.[6] ..... D01F 9/145

[52] U.S. Cl. ..... 423/447.6; 208/39; 208/44; 264/29.2

[58] Field of Search ..... 423/447.6; 208/39, 208/44; 264/29.2

[56] References Cited

U.S. PATENT DOCUMENTS

| | | | |
|---|---|---|---|
| 4,005,183 | 1/1977 | Singer | 208/44 |
| 4,209,500 | 6/1980 | Chwastiak | 208/44 |
| 4,620,919 | 11/1986 | Uemura et al. | 208/45 |
| 4,986,893 | 1/1991 | Seo et al. | 208/39 |

FOREIGN PATENT DOCUMENTS

| | | | |
|---|---|---|---|
| 59-155493 | 9/1984 | Japan | 208/44 |
| 160683 | 6/1988 | Japan . | |

OTHER PUBLICATIONS

H. F. Volk (1977) "High Modulus Pitch–Based Carbon Fibers", pp. 1–6. (no month).

Leonard S. Singer (1977) "The Mesophase and High Modulus Carbon Fibers from Pitch", pp. 408–415. (no month).

*Primary Examiner*—Michael Lewis

*Assistant Examiner*—Stuart L. Hendrickson

*Attorney, Agent, or Firm*—Scully, Scott, Murphy & Presser

[57] ABSTRACT

Pitch-based carbon fibers superior in compression characteristics are obtained by mixing a polycyclic aromatic compound and a hydrogen donating compound at a mole ratio of the latter to the former in the range of 0.1 to 10, polymerizing the resulting mixture at a temperature of 50° to 400° C. in the presence of a Lewis acid as catalyst, then removing the catalyst, thereafter heat-treating the resulting polymer to obtain a pitch containing 5–40% of anisotropic spheres of 5–60 μm, having a total amount of aliphatic hydrogen of 25–50% and an amount of aliphatic hydrogen after β of 5–25% and containing not more than 30% of oriented carbon based on a total amount of aromatic carbon, then spinning said pitch, then making the resulting pitch fiber infusible and subjecting the pitch fiber thus rendered infusible to a carbonization treatment.

10 Claims, No Drawings

PROCESS FOR PRODUCING PITCH-BASED CARBON FIBERS SUPERIOR IN COMPRESSION CHARACTERISTICS

This is a continuation of application Ser. No. 07/882,693 filed on May 14, 1992, now abandoned.

FIELD OF THE INVENTION

The present invention relates to a process for producing pitch-based carbon fibers superior in compression characteristics.

BACKGROUND OF THE INVENTION

Various studies have been made for producing carbon fibers of high strength and high elasticity, using pitch as a starting material. However, composite materials (CFRP) obtained by using pitch-based carbon fibers are disadvantageous in that their compression characteristics, particularly, compressive strength, are markedly inferior in comparison with CFRP prepared by using polyacrylonitrile (PAN)-based carbon fibers. But even such PAN-based carbon fibers have not fully exhibited their features as thin materials utilizing the rigidity of carbon fibers because the compressive strength thereof is deteriorated with increase of elastic modulus.

For improving the compression characteristics of CFRP while utilizing the rigidity of carbon fibers, it is necessary to improve the compression characteristics of the carbon fibers themselves.

It is the object of the present invention to provide a process for producing pitch-based carbon fibers superior in compression characteristics.

SUMMARY OF THE INVENTION

The present invention resides in a process for producing a pitch-based carbon fiber, which process comprises polymerizing a mixture of a polycyclic aromatic compound having at least two aromatic rings and 0.1 to 10, in terms of a mole ratio to the polycyclic aromatic compound, of a hydrogen donating compound, in the presence of a Lewis acid, then removing the catalyst, thereafter heat-treating the resulting polymer at atmospheric pressure or under reduced pressure to obtain a pitch containing 5–40% of optically anisotropic spheres of 5–60 μm and having an amount of transferred hydrogen of 0.3–3 mg/g pitch, a total amount of aliphatic hydrogen of 25–50% as measured by $^1$H-NMR, an amount of aliphatic hydrogen after β of 5–25% and an amount of oriented carbon of 30% out of the whole aromatic carbon as measured by high-temperature melting $^{13}$H-NMR, then spinning said pitch, and subjecting the resulting pitch fiber to a treatment for making the fiber infusible and a carbonization treatment.

The carbon fiber obtained by the above process of the present invention possesses such compression characteristics as have been unattainable in conventional pitch-based carbon fibers.

DETAILED DESCRIPTION OF THE PREFERRED EMBODIMENTS

As the polycyclic aromatic compound used in the present invention, a polycyclic aromatic compound having 2 to 4 aromatic rings is preferred. As the aromatic rings, carboaromatic rings, particularly six-membered carboaromatic rings, are preferred. Above all, fused benzenoid rings are preferred.

Examples are polycyclic aromatic hydrocarbons such as naphthalene, anthracene, phenanthrene and pyrene, as well as $C_{1-3}$ alkyl-substituted products thereof.

The "hydrogen donating compound" as referred to herein indicates a compound which releases hydrogen easily in the presence of a hydrogen acceptor. Particularly preferred are dihydro or tetrahydro polycyclic aromatic compounds corresponding to the above polycyclic aromatic compounds. Examples are such hydrogen donating compounds as tetralin, dihydroanthracene and tetrahydropyrene.

According to the present invention, such polycyclic aromatic compound and hydrogen donating compound are mixed together and polymerized under heating and in the presence of a Lewis acid.

The mixing ratio of both compounds is in the range of 0.1 to 10, preferably 0.5 to 7, in terms of a mole ratio of the hydrogen donating compound to the polycyclic aromatic compound.

As the Lewis acid used as a polymerization catalyst there may be used a conventional Lewis acid such as, for example, $AlCl_3$, $AlBr_3$, $BF_3$ [or an ether complex thereof, e.g. $BF_3 \cdot OEt_2$ (Et: ethyl)].

The amount of the catalyst used is usually in the range of 0.1 to 5 moles, preferably 0.2 to 2 moles, per mole of the polycyclic aromatic compound. An amount of the catalyst exceeding 5 moles is not advisable because not only the yield will not be improved but also the catalyst removing operation is troublesome. And if the amount of the catalyst used is smaller than 0.1 mole, the polymerization will not proceed to a satisfactory extent.

The polymerization is carried out usually at a temperature of 50° to 400° C., preferably 80° to 350° C. If the polymerization temperature exceeds 400° C., polymerization will proceed to excess, so there will be formed a component which is infusible and insoluble at a spinning temperature, thus resulting in marked deterioration of the spinning property. A polymerization temperature lower than 50° C. is not advisable, either, because the yield will be very low.

Next, the catalyst is removed from the resulting polymer. How to remove the catalyst is not specially limited. For example, there may be adopted a method wherein a dilute aqueous hydrochloric acid is added to the polymer to decompose the catalyst, then washing with water is repeated, and finally filtration is performed to remove the catalyst.

If the catalyst is not removed, the polymerization will further proceed in the next heat treatment, thus resulting in the formation of a component which is infusible and insoluble at a spinning temperature and which causes a marked deterioration of the spinning property. And if the catalyst remains even after the formation of a carbon fiber, the mechanical properties of the carbon fiber will be deteriorated markedly.

Then, the polymer is heat-treated at atmospheric pressure or under reduced pressure to obtain a pitch for spinning containing 5–20% of optically anisotropic spheres of 5–60 μm. The heat treatment is performed usually at a temperature of 250°–500° C., preferably 300°–450° C., for usually 0.5 to 50 hours, preferably 1 to 25 hours. It is also desirable to carry out the heat treatment under the supply of an inert gas such as nitrogen.

The spinning pitch obtained by the heat treatment has an amount of transferred hydrogen of 0 to 5 mg/g pitch, preferably 0.3 to 3 mg/g pitch. The amount of transferred hydrogen is determined by $^1$H-NMR according to a known method [T. Yokono, Fuel, 60, 606 (1981)]. More particularly, 10 mmol of the spinning pitch and 10 mmol of anthracene are heated at a rate of 10° C./min under pressure and reacted at 400° C., followed by cooling rapidly. Thereafter, the reaction product is extracted with $CDCl_3$ and a soluble matter content thereof is determined by $^1$H-NMR.

A hydrogen donating ability is determined from production peaks of 9, 10-DHA (peaks of 9, 10-protons).

The total amount of aliphatic hydrogen of the spinning pitch is preferably 25% to 50%, and the amount of aliphatic hydrogen after β is preferably 5% to 25%.

The determination of aliphatic hydrogen is performed by $^1$H-NMR according to a known method [R. A. Greinke, Fuel, 63, 1374 (198)]. More particularly, 0.1 to 1 g of a sample is put into a mixed solvent of 3 g $S_2Cl_2$ and 7 g $SO_2Cl_2$, then stirring is made at room temperature for about 6 hours for solubilization, and $^1$H-NMR spectrum of the resulting solution is measured. From the thus-measured spectrum, the amount of hydrogen (Ha) bonded to aromatic ring carbons, the amount of hydrogen (Hα) bonded directly to aromatic rings and the amount of hydrogen (Hβ) bonded to side-chain aliphatic carbons spaced two or more carbon atoms from aromatic rings are determined using the following equations:

$$\text{Ha}\ (\%) = \frac{\text{(Integrated intensity of 4–12 ppm)}}{\text{(Integrated intensity of 0–15 ppm)}} \times 100$$

$$\text{H}\alpha\ (\%) = \frac{\text{(Integrated intensity of 2–4 ppm)}}{\text{(Integrated intensity of 0–15 ppm)}} \times 100$$

$$\text{H}\beta\ (\%) = \frac{\text{(Integrated intensity of 0–2 ppm)}}{\text{(Integrated intensity of 0–15 ppm)}} \times 100$$

In the spinning pitch obtained in the present invention, it is preferable that the amount of oriented carbon out of the total amount of aromatic carbon be not larger than 30%, more preferably 10% to 25%.

The amount of oriented carbon is determined by $^{13}$C-NMR (MBL-300, a product of Bruker Co.) according to a known method [Nishizawa, 14th Annual Meeting, Carbon Material society, 1A15 (1987)]. About 0.5 g a sample is collected into a sample tube for high temperature NMR having an inside diameter of 9 mm, then the sample tube is put into a probe head for high temperature, followed by heating at a rate of 5° C./min in a current of nitrogen gas, and measurement is made under the condition of a softening point plus 60° C.

The spectrum can be broadly divided into three, one of which is a signal of aliphatic carbon found at 10–40 ppm and the other two are signals of aromatic carbon centered on 130 ppm and 180 ppm. Of the aromatic signals, the 130 ppm signal indicates an aromatic carbon of unoriented molecule, while the 180 ppm signal indicates an aromatic carbon of oriented molecule. The amount of oriented carbon can be determined using the following equation:

$$\text{Amount of oriented carbon} = \frac{\text{(Integrated intensity of 180 ppm)}}{\text{(Integrated intensity of 180 ppm + Integrated intensity of 130 ppm)}}$$

The spinning pitch thus obtained is melt-spun by a known method such as, for example, extrusion or a centrifugal method, to obtain a pitch fiber. Although the melt spinning may be done under known conditions, in order to obtain a carbon fiber superior in compression characteristics intended in the present invention, it is desirable to adopt the conditions of a melt viscosity of 200 to 9,000 poise, a take-up rate of 100 mm or more and a winding tension of 20 mg/pc. or more.

The pitch fiber obtained by the melt spinning is then rendered infusible in an oxidizing gas atmosphere. As the oxidizing gas there usually is employed one or more of oxidizing gases such as, for example, oxygen, ozone, air, nitrogen oxides, halogen and sulfurous acid gas. This infusiblization treatment is carried out under a temperature condition not causing softening and deformation of the pitch fiber treated, for example, at a temperature of 20° to 360° C., preferably 60° to 300° C. The treatment time is usually 5 minutes to 6 hours.

The pitch fiber thus rendered infusible is then carbonized in an inert gas atmosphere to obtain a pitch-based carbon fiber according to the present invention. The carbonization is performed usually at a temperature of 500° to 3,500° C., preferably 800° to 3,000° C. The time required for the carbonization treatment is usually 0.1 minute to 10 hours. The pitch-based carbon fiber thus obtained is superior in compression characteristics, particularly compressive strength.

(Effects of the Invention)

As will be apparent from the following examples, pitch-based carbon fibers produced according to the process of the present invention are not only superior in tensile strength and tensile modulus but also high in compressive strength.

EXAMPLES

The following examples are given to illustrate the present invention more concretely, but the invention is not limited thereto.

Example 1

An anthracene/tetralin mixture (mole ratio=1:1) and aluminum bromide in an amount corresponding to 10 mole % of the total amount of the mixture were fed into a three-necked glass flask and a polymerization reaction was conducted with stirring in a nitrogen atmosphere at 180° C. and at atmospheric pressure for 5 hours. Thereafter, the catalyst was removed by washing with water and filtration to obtain an isotropic pitch. The pitch was then heat-treated at 400° C. for 13 hours under bubbling of nitrogen gas. The resulting pitch had a softening point of 228° C. and a 30% content of anisotropic spheres of about 50 μm. The amount of transferred hydrogen was 2 mg/g pitch. According to the $^1$H-NMR measurement, the amount of aliphatic hydrogen was 43% and that of aliphatic hydrogen after β was 22%. The amount of oriented carbon according to the high-temperature melting $^{13}$C-NMR measurement was 25%. The pitch was spun under the conditions of a melt viscosity of 4,500 poise and a winding tension of 35 mg/pc, using a spinning apparatus having a nozzle diameter of 0.3 mm and an L/D ratio of 1, to obtain a pitch fiber of 14 μm in diameter. The pitch fiber was then heated up to 300° C. at a rate of 0.5° C./min in an oxygen atmosphere and held at that temperature for 30 minutes, then heated up to 700° C. at a rate of 2° C./min in a nitrogen atmosphere and held at that temperature for 30 minutes, then further heated up to 2,300° C. at a rate of 25° C./min in a nitrogen atmosphere to obtain a carbon fiber of 11 μm. This carbon fiber was found to have a tensile strength of 320 kg/mm$^2$ a tensile modulus of 52 t/mm$^2$ and a compressive strength of 75 kg/mm$^2$.

Example 2

A naphthalene/tetralin mixture (mole ratio=1:2) and aluminum chloride in an amount corresponding to 10 mole % of the total amount of the mixture were fed into a three-necked glass flask and a polymerization reaction was conducted with stirring in a nitrogen atmosphere at 180° C. and at atmospheric pressure for 12 hours. Thereafter, the catalyst was removed by washing with water and filtration to obtain an isotropic pitch. The pitch was then heat-treated at 400° C. for 18 hours under bubbling of nitrogen gas. The resulting pitch had a softening point of 215° C. and a 30% content of anisotropic spheres of about 35 μm. The amount of transferred hydrogen was 2.5 mg/g pitch. According to the $^{1}$H-NMR measurement, the amount of aliphatic hydrogen was 30% and that of aliphatic hydrogen after β was 18%. The amount of oriented carbon according to the high-temperature melting $^{13}$C-NMR measurement was 20%. The pitch was spun under the conditions of a melt viscosity of 3,000 poise and a winding tension of 28 mg/pc, using a spinning apparatus described in Example 1, to obtain a pitch fiber having a diameter of 12 μm. The pitch fiber was then carbonized in the same way as in Example 1 to obtain a carbon fiber of 10.5 μm. This carbon fiber was found to have a tensile strength of 350 kg/mm$^2$ a tensile modulus of 60 t/mm$^2$ and a compressive strength of 70 kg/mm$^2$.

Example 3

A 2-methylnaphthalene/tetralin mixture (mole ratio=1:1) and aluminum chloride in an amount corresponding to 10 mole % of the total amount of the mixture were fed into a three-necked glass flask and a polymerization reaction was conducted with stirring in a nitrogen atmosphere at 180° C. and at atmospheric pressure for 8 hours. Thereafter, the catalyst was removed by washing with water and filtration to obtain an isotropic pitch. The pitch was then heat-treated at 400° C. for 16 hours under bubbling of nitrogen gas. The resulting pitch had a softening point of 208° C. and a 20% content of anisotropic spheres of about 20 μm. The amount of transferred hydrogen was 3 mg/g pitch. According to the $^{1}$H-NMR measurement, the amount of aliphatic hydrogen was 45% and that of aliphatic hydrogen after β was 25%. The amount of oriented carbon according to the high-temperature melting $^{13}$C-NMR measurement was 10%. The pitch was spun under the conditions of a melt viscosity of 3,500 poise and a winding tension of 20 mg/pc, using the spinning apparatus described in Example 1, to obtain a pitch fiber having a diameter of 12 μm. The pitch fiber was then carbonized in the same way as in Example 1 to obtain a carbon fiber of 10 μm. This carbon fiber was found to have a tensile strength of 290 kg/mm$^2$, a tensile modulus of 45 t/mm$^2$ and a compressive strength of 88 kg/mm$^2$.

Comparative Example 1

Anthracene and 10 mole %, based on the amount of the anthracene, of aluminum chloride were fed into a three-necked glass flask and a polymerization reaction was performed with stirring in a nitrogen atmosphere at ]80° C. and at atmospheric pressure for 5 hours. Thereafter, the catalyst was removed by washing with water and filtration to obtain an isotropic pitch. The pitch was then heat-treated at 400° C. for 2 hours under bubbling of nitrogen gas. The resulting pitch had a softening point of 235° C. and a 30% content of anisotropic spheres. It was impossible to melt-spin the pitch stably.

Comparative Example 2

Naphthalene and 10 mole %, based on the amount of the naphthalene, of aluminum chloride were fed into a three-necked glass flask and a polymerization reaction was performed with stirring in a nitrogen atmosphere at 180° C. and at atmospheric pressure for 12 hours. Thereafter, the catalyst was removed by washing with water and filtration to obtain an anisotropic pitch. The pitch was then heat-treated at 400° C. for 15 hours under bubbling of nitrogen gas. The resulting pitch had a softening point of 215° C. and a 25% content of anisotropic spheres of 70–80 μm. It was impossible to melt-spin the pitch stably and there could be obtained only yarn having an uneven surface.

What is claimed is:

1. A process for producing a carbon fiber, which process comprising mixing a polycyclic aromatic compound and a hydrogen donating compound at a mole ratio of the latter to the former in the range of 0.1 and 10, polymerizing the resulting mixture at a temperature of 50° to 400° C. in the presence of a Lewis acid as catalyst, then removing the catalyst, thereafter heat-treating the resulting polymer to obtain a pitch containing 5–40% of anisotropic spheres of 5–60 μm, having a total amount of aliphatic hydrogen of 25–50% and an amount of aliphatic hydrogen bonded to aliphatic carbons spaced two or more carbon atoms from aromatic rings of 5–25% and containing not more than 30% of oriented carbon based on the total amount of aromatic carbon, then spinning said pitch, then making the resulting pitch fiber infusible and subjecting the pitch fiber thus rendered infusible to a carbonization treatment.

2. A process as set forth in claim 1, wherein the polycyclic aromatic compound has 2 to 4 aromatic rings.

3. A process as set forth in claim 2, wherein the aromatic rings of the polycyclic aromatic rings are fused benzenoid rings.

4. A process as set forth in claim 3, wherein the polycyclic aromatic compound is naphthalene, anthracene, phenanthrene, pyrene, or a $C_{1-3}$ alkyl-substituted product thereof.

5. A process as set forth in claim 1, wherein the hydrogen donating compound is a dihydro- or tetrahydro-polycyclic aromatic compound.

6. A process as set forth in claim 5, wherein the hydrogen donating compound is tetralin, dihydroanthracene, dihydrophenanthrene, or tetrahydropyrene.

7. A process as set forth in claim 1, wherein the Lewis acid is a non-protonic Lewis acid.

8. A process as set forth in claim 7, wherein the Lewis acid is $AlCl_3$, $AlBr_3$, $BF_3$, or an ether complex of $BF_3$.

9. A process as set forth in claim 1, wherein the polymerization temperature is in the range of 80° to 350° C.

10. A process as set forth in claim 1, wherein the content of oriented carbon in said pitch is in the range of 10% to 25%.

* * * * *

UNITED STATES PATENT AND TRADEMARK OFFICE

CERTIFICATE OF CORRECTION

PATENT NO. : 5,470,558

DATED : November 28, 1995

INVENTOR(S) : Hiroaki Takashima, et al.

It is certified that error appears in the above-indentified patent and that said Letters Patent is hereby corrected as shown below:

Column 2, line 57: "5-20%" should read --5-40%--

Column 2, line 64: "0 to 5" should read --0.1 to 5--

Column 3, line 13: "(198)" should read --(1984)--

Column 3, line 39: "(MBL" should read --(MSL--

Signed and Sealed this

Twenty-sixth Day of November 1996

*Attest:*

Bruce Lehman

BRUCE LEHMAN

*Attesting Officer*

*Commissioner of Patents and Trademarks*